US011124910B2

(12) United States Patent
Callewaert

(10) Patent No.: US 11,124,910 B2
(45) Date of Patent: Sep. 21, 2021

(54) METHOD OF PREPARING A TUFTING PROCESS FOR TUFTING A FABRIC, PREFERABLY CARPET

(71) Applicant: Vandewiele NV, Kortrijk/Marke (BE)

(72) Inventor: Koen Callewaert, Tielt (BE)

(73) Assignee: VANDEWIELE NV, Kortrijk/Marke (BE)

( * ) Notice: Subject to any disclaimer, the term of this patent is extended or adjusted under 35 U.S.C. 154(b) by 44 days.

(21) Appl. No.: 16/332,941

(22) PCT Filed: Sep. 7, 2017

(86) PCT No.: PCT/EP2017/072410

§ 371 (c)(1),
(2) Date: Mar. 13, 2019

(87) PCT Pub. No.: WO2018/054688

PCT Pub. Date: Mar. 29, 2018

(65) Prior Publication Data

US 2019/0249347 A1 Aug. 15, 2019

(30) Foreign Application Priority Data

Sep. 22, 2016 (EP) ..... 16190104

(51) Int. Cl.
*D05C 15/34* (2006.01)
*D05C 15/32* (2006.01)

(52) U.S. Cl.
CPC ..... *D05C 15/34* (2013.01); *D05C 15/32* (2013.01)

(58) Field of Classification Search
CPC ..... D05C 15/32; D05C 15/08; D05C 15/34; D05C 5/02; D05B 19/08; D05B 19/10
USPC ..... 112/80.01, 80.54, 80.23
See application file for complete search history.

(56) References Cited

U.S. PATENT DOCUMENTS 3,067,701 A 12/1962 Wilcox
3,220,371 A 11/1965 Short et al.
3,338,198 A * 8/1967 Short ..... D05C 15/34 112/410
3,850,783 A * 11/1974 Peters ..... D05C 15/26 428/89

(Continued)

FOREIGN PATENT DOCUMENTS

GB 2 393 454 3/2004

OTHER PUBLICATIONS

Written Opinion and International Search Report of PCT/EP2017/072410 dated Oct. 17, 2017, 14 pages.

*Primary Examiner* — Alissa L Hoey
*Assistant Examiner* — Patrick J. Lynch
(74) *Attorney, Agent, or Firm* — Rankin, Hill & Clark LLP

(57) ABSTRACT

A method of preparing a tufting process for tufting a fabric, preferably carpet, having regions (14, 16, 18) of different color appearance by using at least two different kinds of yarns, yarns of different kinds of yarns (b, w) alternately following each other in a needle bar longitudinal direction of a needle bar of a tufting machine, comprises the steps of: a) defining a predetermined number of color mixing values, b) assigning with each color mixing value a color-related tufting aspect instruction, c) providing a color pattern representation (11) of the fabric to be tufted comprising a plurality of color regions (14, 16, 18), d) assigning with each color region (14, 16, 18) one of the color mixing values.

6 Claims, 2 Drawing Sheets

(56) References Cited

U.S. PATENT DOCUMENTS

| | | | | |
|---|---|---|---|---|
| 5,058,518 | A * | 10/1991 | Card | D05C 15/26 112/410 |
| 6,244,203 | B1 * | 6/2001 | Morgante | D05C 15/18 112/475.23 |
| 2001/0029877 | A1 * | 10/2001 | Morgante | D05C 15/18 112/80.23 |
| 2003/0091214 | A1 * | 5/2003 | Gould | G06T 11/001 382/111 |
| 2008/0249794 | A1 * | 10/2008 | Bradford | G06Q 30/02 705/1.1 |
| 2010/0106283 | A1 * | 4/2010 | Harvill | D05C 5/04 700/138 |
| 2017/0260668 | A1 * | 9/2017 | Jones | D05C 5/00 |
| 2018/0282928 | A1 * | 10/2018 | Marijsse | G05B 15/02 |

* cited by examiner

METHOD OF PREPARING A TUFTING PROCESS FOR TUFTING A FABRIC, PREFERABLY CARPET

The present invention relates to a method of preparing a tufting process for tufting a fabric, for example, for tufting a carpet. The invention further relates to a method of tufting a fabric by using such a method of preparing a tufting process.

When tufting a fabric, for example, a carpet, with a tufting machine, the needles of a needle bar of this tufting machine have respective yarns associated therewith. By selecting the colors of the yarns associated with the needles provided on the needle bar, a fabric tufted with the tufting machine having such a specific threading will have a specific color appearance primarily defined by the colors of the yarns associated with the needles.

It is an object of the present invention to provide a method of preparing a tufting process by means of which, even when using a reduced number of differently colored yarns, an enhanced color appearance can be obtained.

According to the present invention, this object is achieved by a method of preparing a tufting process for tufting a fabric, preferably carpet, having regions of different color appearance by using at least two different kinds of yarns, yarns of different kinds of yarns alternately following each other in a needle bar longitudinal direction of a needle bar of a tufting machine, comprising the steps of:

a) defining a predetermined number of color mixing values,
b) assigning with each color mixing value a color-related tufting aspect instruction,
c) providing a color pattern representation of the fabric to be tufted comprising a plurality of color regions,
d) assigning with each color region one of the color mixing values.

When preparing a tufting process by using the method of the present invention, the color appearance of a fabric tufted on the basis of this method is not only influenced by the selected different kinds of yarns, but also by using particular tufting aspect instructions and thereby generating tuft piles in line with these instructions in association with the different color mixing values of the different color regions of the color pattern representation. Combining the use of particular kinds of yarns with the use of particular tufting aspect instructions leads to a broadened spectrum of the colors which seem to be present in the fabric.

An essential influence on the color appearance of a fabric to be tufted can be obtained if the color-related tufting aspect instruction indicates a pile height of a pile to be tufted.

For making sure that, in association with each color region of the color pattern representation, a specific kind of color appearance can be obtained, it is proposed that the number of color regions is equal to or less than the predetermined number of color mixing values.

Step c) may comprise generating the color pattern representation on the basis of an image representation having image regions of different color, the number of differently colored image regions exceeding the predetermined number of color mixing values. For example, a photograph, in particular a black-and-white photograph, can be used as an image representation being the basis for the color pattern representation.

For providing the option of influencing the color appearance of respective color regions by selecting the color mixing values and thereby selecting the associated tufting aspect instructions, step b) may comprise assigning to each color mixing value a separate yarn-related tufting aspect instruction for each one of the different kinds of yarns.

For providing a variation of the yarn-related tufting aspect instruction in association with the various color mixing values, the method may be arranged such that in association with a color mixing value defining a first end of the color mixing value range comprising all color mixing values, the yarn-related tufting aspect instruction associated with one of the different kinds of yarns indicates a maximum pile height of a pile to be tufted, and in association with a color mixing value defining a second end of the color mixing value range, the yarn-related tufting aspect instruction associated with this one of the different kinds of yarns indicates a minimum pile height of a pile to be tufted, in association with the color mixing value defining the first end of the color mixing value range, the yarn-related tufting aspect instruction associated with another one of the different kinds of yarns indicates a minimum pile height of a pile to be tufted, and in association with the color mixing value defining the second end of the color mixing value range, the yarn-related tufting aspect instruction associated with the other one of the different kinds of yarns indicates a maximum pile height of a pile to be tufted.

If the color mixing values are represented by numbers, the color mixing value defining the first end of the color mixing value range may be a minimum color mixing value, and the color mixing value defining the second end of the color mixing value range may be a maximum color mixing value.

In association with at least two color mixing values, preferably each color mixing value, for at least one of the different kinds of yarns, preferably each one of the different kinds of yarns, the yarn-related tufting aspect instructions assigned with these color mixing values may indicate different pile heights.

According to a very advantageous aspect of the present invention, different kinds of yarns may differ from each other in yarn color. For example, the yarns of one kind of yarns may be white yarns, while the yarns of another kind of yarns may be black yarns.

According to the present invention, it is preferred that, within at least one kind of yarns, preferably within each kind of yarns, the yarns do not differ from each other. This means that, if different kinds of yarns differ in yarn color, all the yarns of one kind of yarns, for example, may be white yarns and all the yarns of the other kind of yarns may be black yarns.

It is one of the advantageous aspects of the present invention that the use of two (which means exactly two) different kinds of yarns is sufficient for providing a color appearance of a tufted fabric having a wide range of color variations.

The method of the present invention may further comprise generating a tufting machine control file on the basis of the color-related tufting aspect instructions associated with all the color regions.

For providing a set of data representing the instructions in association with the piles to be generated when tufting a fabric, the tufting machine control file may be provided such that, in association with each pile to be generated, on the basis of the kind of yarns to be used for making a particular pile and the color-related tufting aspect instruction associated with this pile, the yarn-related tufting aspect instruction associated with the kind of yarns to be used for making this pile is selected.

A further aspect of preparing a method of tufting a fabric comprises the selection and/or provision of a tufting machine provided with such a threading of needles of a needle bar of the tufting machine that yarns of the different kinds of yarns follow each other in a needle bar longitudinal direction in an alternating manner.

The present invention further relates to a method of tufting a fabric, comprising the steps of:

generating a tufting machine control file by using the method of the present invention, forwarding the tufting machine control file to a tufting machine prepared for carrying out the tufting process, operating the tufting machine on the basis of the tufting machine control file.

The present invention will now be explained with reference to the drawings, in which.

Figures 3A, 3B, 3C:
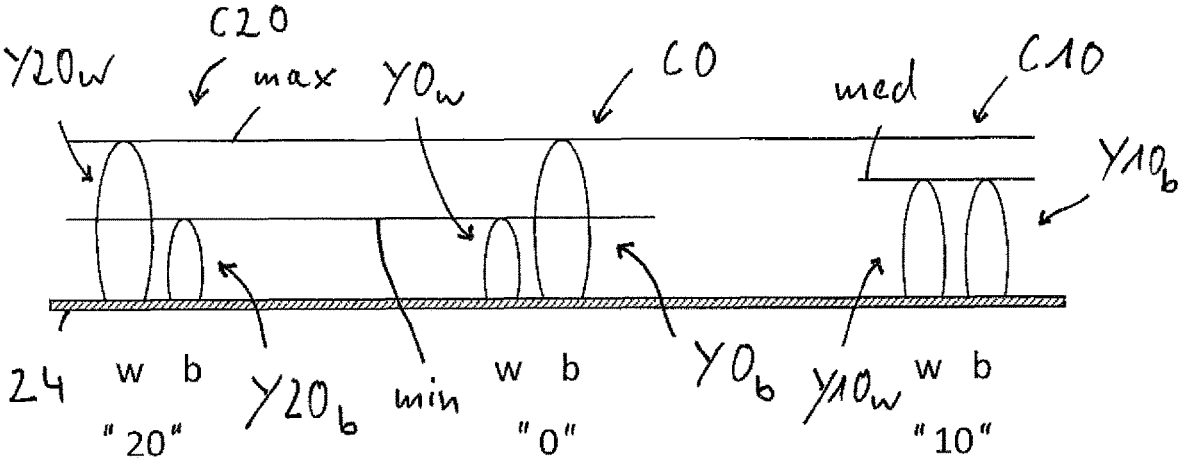

FIGS. 3*a*-3*c* show the tufting aspect instructions for two yarns of two different kinds of yarns associated with different color mixing values.

With respect to the drawings, the present invention will now be explained by using an example in which, for tufting a fabric, two different kinds of yarns are to be used. In this example, the yarns of the two different kinds of yarns differ in color. For example, the yarns of one of the kinds of yarns may be white yarns, while the yarns of the other kind of yarns may be black yarns. Within each kind of yarns, the yarns preferably do not differ from each other, which, for example, means that all yarns of the one kind of yarns are white yarns, while all yarns of the other kind of yarns are black yarns.

It is to be noted that, within the principles of the present invention, the different kinds of yarns may alternatively or additionally differ in other aspects than the yarn color. For example, the yarns of the different kinds of yarns may differ in thickness, material, surface structure and any other physical parameter influencing the optical appearance of such yarns.

Figure 1:
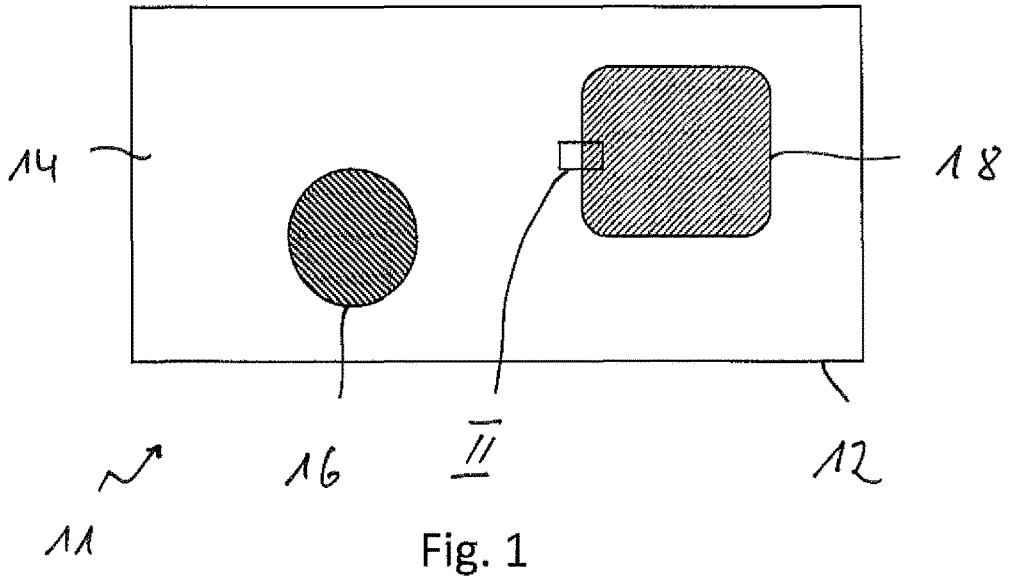
FIG. 1 shows a pattern representation of a fabric to be tufted having three color regions.

FIG. 1 shows a color pattern representation 11 of a fabric, for example, a carpet, to be tufted. The color pattern representation 11 of FIG. 1 shows an outline 12 corresponding to the outline of the fabric to be tufted. The color pattern representation 11 shows three color regions 14, 16 and 18. Each one of the color regions 14, 16, 18 indicates a region of the fabric to be tufted which is intended to have a uniform color appearance. For example, when using different kinds of yarns, one having white yarns and the other one having black yarns, color region 14 may be a color region in which the fabric to be tufted is intended to have a white color appearance, while color region 16 may be a region in which the fabric to be tufted is intended to have a black color appearance. Color region 18 may be a region of the fabric to be tufted which is intended to have a gray appearance. It is to be noted that, within a fabric or a color pattern representation constituting the basis for tufting a fabric, such a color region may comprise a plurality of areas distributed over the fabric and not being in contact with each other but being separated from each other by one or a plurality of other color regions. However, all these areas of one and the same color region are intended to have the same color appearance.

The color pattern representation shown in FIG. 1 may be obtained starting out from an image representation, for example, a black-and-white picture, having a wide variety of differently colored regions and more or less smooth color transitions between these differently colored regions. Starting out from such an image representation, the number of differently colored regions is reduced such as not to exceed a predetermined number of color mixing values. Reducing the number of differently colored regions can be done by any known picture processing software provided for reducing the number of shades, for example, shades of gray, if the image representation is a black-and-white picture.

In the method of the present invention, a plurality of color mixing values is defined, each color mixing value representing a different ratio between the presence of one color and the presence of at least one other color. For example, when using black-and-white yarns and a black-and-white image as the basis for generating the color pattern representation 11, the color mixing values may be represented by different shades of gray. These color mixing values may have different numbers associated therewith such that, for example, a color mixing value indicated by the number "0" stands for the darkest possible color appearance, i.e. an essentially black color appearance, if black and white yarns are used in the different kinds of yarns. The color mixing value indicated by number "20" may be used for the brightest color appearance, for example, an essentially white color appearance, if black and white yarns are used for the different kinds of yarns. The numbers "1", "2", "3" . . . between "0" and "20", in this particular case, may be representative of different shades of gray between black and white. When providing color mixing values from "0" to "20", i.e. when providing a total predetermined number of 21 color mixing values, the color pattern representation 11 generated starting out from an image representation is provided such as not to contain more than 21 differently colored regions. Of course, the color pattern representation 11 can contain more than 21 regions, if there are separated regions which are intended to have the same color appearance and therefor to have the same color mixing value associated therewith.

Figure 2:
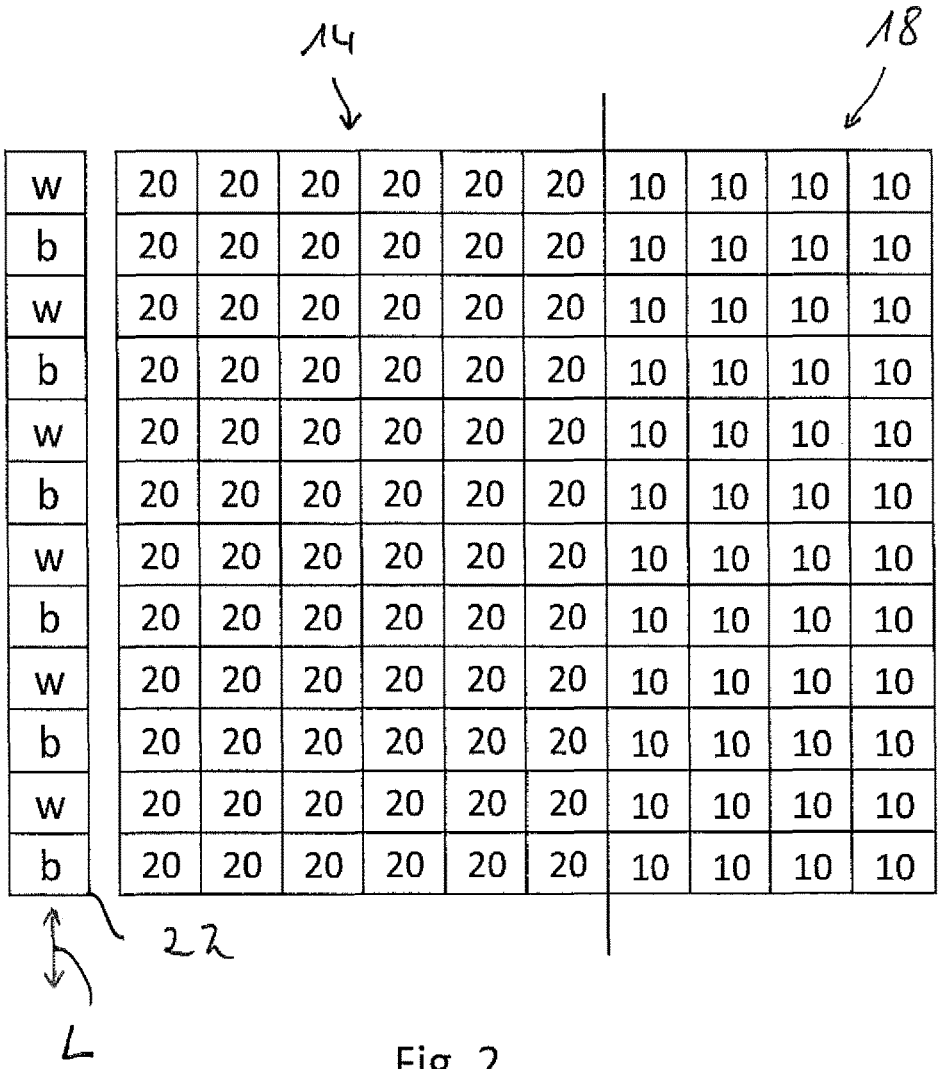
FIG. 2 is an enlarged view of rectangle II depicted in FIG. 1 showing the color mixing values assigned with two of the color regions.

FIG. 2 shows the transition between the two color regions 14 and 18 shown in rectangle II in FIG. 1. As color region 14 is intended to have the brightest color appearance, i.e. the essentially white color appearance, the color mixing value "20" is associated with this color region 14. As color region 18 is intended to have a medium bright color appearance, i.e. a not too dark and not too bright gray color appearance, the color mixing value "10" is associated with this entire color region 18. In FIG. 2, each square showing one of the numbers "20" and "10" indicates one stitch to be carried out during a tufting process and therefore indicates one pile which will be present in the fabric to be tufted. The lines in FIG. 2 indicate all those piles which will be made by one and the same needle provided on a needle bar 22 of a tufting machine, which needles are positioned side by side following each other in a needle bar longitudinal direction L. As can be seen in FIG. 2, the threading of the needles of the needle bar 22 is such that yarns of the one kind of yarns and yarns of the other kind of yarns are provided in an alternating manner. A needle having a black yarn b threaded therethrough is positioned between two needles having white yarns w threaded therethrough and vice versa. This means that, in the fabric to be tufted, there will be rows of piles corresponding to the lines shown in FIG. 2, the piles provided within one such row being made by the same yarn and therefore having the same color, while piles provided in immediately adjacent rows of piles will be made of yarns associated with the two different kinds of yarns and therefore will have different colors.

When using a tufting machine having a sliding needle bar, the piles provided within one row may be made of different yarns and therefore can have different colors. As a further option, a tufting machine having two needle bars extending substantially parallel to each other in the needle bar longitudinal direction may be used. One of the needle bars may have the yarns of the one kind of yarns threaded through the needles thereof, and the other needle bar may have the yarns of the other kind of yarns threaded through the needles thereof. Even when using such a tufting machine and a yarn threading, respectively, immediately adjacent rows of piles may be tufted by alternately using yarns of the one kind of yarns and yarn of the other kind of yarns threaded through the needles of the two different needle bars.

FIGS. 3*a*-3*c* show the association of respective color-related tufting aspect instructions C with color mixing values. For example, the color-related tufting aspect instruction C20 associated with color mixing value "20", which, in the range of color mixing values, is the maximum color mixing value, comprises a separate yarn-related tufting aspect instruction Y in association with each one of the two different kinds of yarns, i.e. in association with the white yarns w on the one hand and the black yarns b on the other hand. In the example shown, the relevant tufting aspect is the pile height, and each yarn-related tufting aspect instruction Y is indicative of how high a pile has to be. In FIG. 3*a*, the color-related tufting aspect instruction C20 associated with the color mixing value "20" comprises the yarn-related tufting aspect instruction Y$\mathbf{20}_w$ associated with the white yarns w and the yarn-related tufting aspect instruction Y$\mathbf{20}_b$ associated with the black yarns b. As the tufting aspect of interest is the pile height, these yarn-related tufting aspect instructions Y$\mathbf{20}_w$, Y$\mathbf{20}_b$ are represented by high and low loops starting out from a substrate 24 indicative of a high pile, in particular a high loop pile, and a low pile, in particular a low loop pile.

As stated above, color mixing value "20" is indicative of a very bright color appearance and therefore the yarn-related tufting aspect instruction Y$\mathbf{20}_w$ associated with the white yarns w may be indicative of a maximum pile height max, while the yarn-related tufting aspect instruction Y$\mathbf{20}_b$ associated with the black yarns b may be indicative of a minimum pile height min. This means that, in color region 14 intended to have a substantially white color appearance, the piles generated by using white yarns w will have the maximum pile height max, while the piles generated by using the black yarns will have the minimum pile height min. For example, the maximum pile height max may be twice the minimum pile height min. Due to this substantial difference in pile height, the color appearance in color region 14 will be dominated by the white piles, while the black piles will be substantially hidden between the higher white piles.

FIG. 3*b* shows the color-related tufting aspect instruction C0 associated with color mixing value "0" comprising yarn-related tufting aspect instructions Y$\mathbf{0}_b$ and Y$\mathbf{0}_w$. As the color mixing value "0" being the minimum color mixing value is indicative of a very dark color appearance, yarn-related tufting aspect instruction Y$\mathbf{0}_b$ indicates the generation of a pile having the maximum pile height max and yarn-related tufting aspect instruction Y$\mathbf{0}_w$ indicates the generation of a pile having the minimum pile height min. Again, the color appearance will be dominated by the color of the yarns providing the high piles, i.e. the black yarns, in color region 16.

FIG. 3*c* shows a color-related tufting aspect instruction C10 associated with the intermediate color mixing value "10". Color-related tufting aspect instruction C10 comprises the two yarn-related tufting aspect instructions Y$\mathbf{10}_w$ and Y$\mathbf{10}_b$, both indicating the generation of piles having the same intermediate height med. Therefore, none of the two yarn colors will be predominant in an area having the color mixing value "10" associated therewith. Such an area is depicted by color region 18 in FIG. 1.

The pile height associated with the different yarn-related tufting aspect instructions and therefore associated with the different color mixing values can be determined on the basis of the following equations:

$$P_w = \min + (\max - \min) \times CMV/20$$

$$P_b = \max - (\max - \min) \times CMV/20$$

wherein:

$P_w$ is the pile height of the piles generated by using white yarns w;

$P_b$ is the pile height of piles generated by using black yarns b;

CMV is the color mixing value selected from the value range "0", "1", "2" . . . "19", "20";

max is the maximum pile height;

min is the minimum pile height.

By using the above formulas, in association with each one of the color mixing values provided within the color mixing value range, a different pile height for all the piles generated with white yarns and all the piles generated with black yarns on the basis of the different color mixing values contained within the color mixing value range will be obtained. Of course, in association with one color-related tufting aspect instruction unit, there may be yarn-related tufting aspect instructions indicating the generation of white piles and black piles having the same height.

While the above formulas indicate a linear increase/decrease of the pile heights in association with an increasing color mixing value, other correlations between the color mixing value and the increase/decrease of the pile heights of differently colored yarns may be used. For example, a parabolic or a hyperbolic increase/decrease of the pile heights with an increasing color mixing value may be provided.

From the above explanation and FIGS. 2 and 3*a* to 3*c*, it becomes clear that, in association with each particular pile to be tufted in a particular color region and on the basis of a particular color mixing value and the associated color-related tufting aspect instruction C0, . . . C20, only the one yarn-related tufting aspect instruction will be relevant, which relates to the yarn of the particular kind of yarns with which a particular pile is to be tufted. For example, in the first line of FIG. 2 indicating a row of piles to be tufted by using a white yarn w, only yarn-related tufting aspect instructions Y$\mathbf{20}_w$ and Y$\mathbf{10}_w$ will be relevant, while, in association with the row of piles corresponding to the second line and tufted by using a black yarn b, only the yarn-related tufting aspect instructions Y$\mathbf{20}_b$ and Y$\mathbf{10}_b$ will be relevant when tufting a fabric and when generating a tufting machine control file.

For generating such a tufting machine control file, the information relating to the color mixing values associated with particular color regions, and therefore associated with particular stitches to be carried out, will be combined with the information about the yarn threading of the needle bar of a tufting machine which has been selected for carrying out the tufting process. If, for example, the yarn threading shown in FIG. 2 is used, in which, in association with the upper row of piles to be generated, a white yarn w is used, while, in association with the next row of piles to be tufted, a black yarn b is used, for each single stitch to be carried out, the yarn-related tufting aspect instruction of a respective color-related tufting aspect instruction associated with the particular kind of yarn used, in association with a particular needle and therefore used for generating a particular row of piles, will be used in the tufting machine control file for making sure that, when tufting a fabric and carrying out a particular stitch, the pile generated will have the pile height defined by the color mixing value and the associated color-related tufting aspect instruction and the kind of yarn used in association with this needle.

By associating particular color mixing values with each single stitch and selecting only the part of the color-related tufting aspect instruction associated with a particular color mixing value that is relevant for the yarn to be used for making a particular stitch, i.e. the yarn-related tufting aspect instruction associated with this particular kind of yarn, while disregarding the part of the information associated with other kinds of yarns not to be used for making a particular stitch, it becomes possible to make each single stitch part of each different kind of color region. It is not necessary to select a group of immediately adjacent stitches to be made with yarns of different kinds for defining a pixel and adjusting the color appearance of such a pixel by selecting particular heights of the piles made with the yarns of different kinds of this pixel, thereby only allowing the association of this entire pixel comprising a plurality of stitches with different color regions. This means that, by associating a color mixing value with each single stitch to be made and selecting only the information which is relevant for the kind of yarn to be used for making such a particular stitch, with the method of the present invention a pixel which is allowed to be part of either one of the color regions comprises one single stitch leading to a substantially higher definition of the various color regions and the pattern to be represented on or by a fabric, respectively.

When preparing a method of tufting a fabric in line with the principles of the present invention, there may be provided a plurality of color-related tufting aspect instruction layers, each color-related tufting aspect instruction layer indicating those areas, i.e. those stitches to be carried out during the tufting process, in which a specific color-related tufting aspect instruction and therefore a specific color mixing value is to be provided. Each one of these layers may be depicted on a monitor individually and separated from the other layers for allowing local corrections to be carried out, i.e. changes of the color mixing value and the associated color-related tufting yarn instruction, if necessary. Further, there may be provided a plurality of yarn-related tufting aspect instruction layers, each yarn-related tufting aspect instruction layer showing regions in which a particular yarn-related tufting aspect instruction is to be used. Again, providing a plurality of such layers allows changes in particular areas to be carried out for substituting a previously assigned yarn-related tufting aspect instruction for another yarn-related tufting aspect instruction, if necessary. On the basis of these yarn-related tufting aspect instruction layers, assigning one single selected yarn-related tufting aspect instruction to each stitch to be carried out when tufting a fabric can be used for generating the tufting machine control file.

The invention claimed is:

1. A method of tufting a fabric having regions of different color appearance by using at least two different kinds of yarns, yarns of different kinds of yarns alternately following each other in a needle bar longitudinal direction of a needle bar of a tufting machine selected for tufting the fabric and being arranged for tufting piles having a pile height out of a plurality of different pile heights, comprising the steps of:

generating a tufting machine control file by:

a) defining a predetermined number of color mixing values, b) assigning with each color mixing value a color-related tufting aspect instruction indicative of a pile height of a pile to be tufted, comprising assigning to each color mixing value a separate yarn-related tufting aspect instruction for each one of the different kinds of yarns, each tufting aspect instruction indicating a pile height of a pile to be tufted with the different kinds of yarns, each pile height of a pile to be tufted with the different yarns being one of the pile heights of the plurality of different pile heights, wherein:

in association with a color mixing value defining a first end of a color mixing value range comprising all color mixing values, the yarn-related tufting aspect instruction associated with one of the different kinds of yarns indicates a maximum pile height of the pile to be tufted, and in association with a color mixing value defining a second end of the color mixing value range, the yarn-related tufting aspect instruction associated with the one of the different kinds of yarns indicates a minimum pile height of the pile to be tufted, and in association with the color mixing value defining the first end of the color mixing value range, the yarn-related tufting aspect instruction associated with another one of the different kinds of yarns indicates the minimum pile height of the pile to be tufted, and in association with the color mixing value defining the second end of the color mixing value range, the yarn-related tufting aspect instruction associated with the other one of the different kinds of yarns indicates the maximum pile height of the pile to be tufted, c) providing a color pattern representation of the fabric to be tufted comprising a plurality of color regions, a number of color regions being equal to or less than the predetermined number of color mixing values, and d) assigning with each color region one of the color mixing values of the predetermined number of color mixing values, wherein the tufting machine control file is generated on the basis of the color-related tufting aspect instructions associated with all the color regions and is provided such that, in association with each pile to be tufted, on the basis of the kind of yarns to be used for making a particular pile and the color-related tufting aspect instruction associated with the particular pile, the yarn-related tufting aspect instruction associated with the kind of yarns to be used for making the pile is selected, forwarding the tufting machine control file to the tufting machine prepared for carrying out a tufting process, wherein the tufting machine is provided with such a threading of needles of the needle bar of the tufting machine that yarns of the different kinds of yarns follow each other in the needle bar longitudinal direction in an alternating manner, and operating the tufting machine on the basis of the tufting machine control file.

2. The method according to claim 1, wherein step c) comprises generating the color pattern representation on the basis of an image representation having image regions of different color, a number of differently colored image regions exceeding the predetermined number of color mixing values.

3. The method according to claim 1, wherein the color mixing value defining the first end of the color mixing value range is a minimum color mixing value, and wherein the color mixing value defining the second end of the color mixing value range is a maximum color mixing value.

4. The method according to claim 1, wherein, in association with at least two color mixing values, for at least one of the different kinds of yarns, the yarn-related tufting aspect instructions assigned with the at least two color mixing values indicate different pile heights.

5. The method according to claim 1, wherein different kinds of yarns differ from each other in yarn color.

6. The method according to claim 1, wherein two different kinds of yarns are used.

* * * * *